US009360843B2

(12) United States Patent
Kadmiri et al.

(10) Patent No.: US 9,360,843 B2
(45) Date of Patent: Jun. 7, 2016

(54) MUSICAL OR STRIKING WATCH PROVIDED WITH AN ACOUSTIC RADIATION ARRANGEMENT

(71) Applicant: Montres Breguet S.A., L'Abbaye (CH)

(72) Inventors: Younes Kadmiri, Morre (FR); Davide Sarchi, Renens (CH); Nakis Polychronis Karapatis, Premier (CH)

(73) Assignee: Montres Breguet SA, L'Abbaye (CH)

( * ) Notice: Subject to any disclaimer, the term of this patent is extended or adjusted under 35 U.S.C. 154(b) by 0 days.

(21) Appl. No.: 14/856,771

(22) Filed: Sep. 17, 2015

(65) Prior Publication Data

US 2016/0109855 A1 Apr. 21, 2016

(30) Foreign Application Priority Data

Oct. 15, 2014 (EP) ..... 14189093

(51) Int. Cl.

| | |
|---|---|
| ***G04B 21/02*** | (2006.01) |
| ***G04B 23/02*** | (2006.01) |
| ***G04B 37/00*** | (2006.01) |
| ***G04C 21/02*** | (2006.01) |
| ***G04C 21/34*** | (2006.01) |
| ***G04B 23/12*** | (2006.01) |

(52) U.S. Cl.

CPC ..... *G04B 37/0075* (2013.01); *G04B 21/02* (2013.01); *G04B 23/028* (2013.01); *G04B 23/12* (2013.01); *G04C 21/02* (2013.01); *G04C 21/34* (2013.01)

(58) Field of Classification Search

CPC ..... G04B 21/02; G04B 23/028; G04B 23/12; G04B 37/0075; G04C 21/02; G04C 21/34

USPC ..... 368/72, 75, 244, 245, 272, 281

See application file for complete search history.

(56) References Cited

U.S. PATENT DOCUMENTS

| | | | | |
|---|---|---|---|---|
| 4,250,573 | A * | 2/1981 | Saito | G04G 17/02 340/387.1 |
| 4,374,624 | A * | 2/1983 | Murata | G04C 21/02 368/250 |
| 4,391,532 | A * | 7/1983 | Hara | G10K 9/13 368/250 |
| 4,534,661 | A * | 8/1985 | Kurita | G04G 13/021 368/244 |
| 5,867,452 | A * | 2/1999 | Braun | G04G 21/06 368/250 |
| 6,219,304 | B1 | 4/2001 | Mignot et al. | |

FOREIGN PATENT DOCUMENTS

| | | |
|---|---|---|
| CH | 702 840 A2 | 9/2011 |
| EP | 2 503 417 A1 | 9/2012 |
| EP | 2 672 331 A1 | 12/2013 |
| FR | 2 777 095 A1 | 10/1999 |

OTHER PUBLICATIONS

European Search Report for EP 14 18 9093 dated Jul. 14, 2015.

* cited by examiner

*Primary Examiner* — Vit W Miska

(74) *Attorney, Agent, or Firm* — Sughrue Mion, PLLC

(57) ABSTRACT

The musical or striking watch is provided with an acoustic radiation arrangement. The watch includes a watch case, formed at least of a case middle and a back cover removably fixed to the case middle, and at least one crystal for closing said case. The acoustic radiation arrangement includes a connecting support part fixed in the case back between a back bezel and a back crystal. The back bezel includes several lateral openings. A cavity is defined between the connecting support part and the openings in the back bezel.

26 Claims, 3 Drawing Sheets

MUSICAL OR STRIKING WATCH PROVIDED WITH AN ACOUSTIC RADIATION ARRANGEMENT

This application claims priority from European Patent Application No. 14189093.9 filed Oct. 15, 2014, the entire disclosure of which is incorporated herein by reference.

FIELD OF THE INVENTION

The invention concerns a musical or striking watch, which is provided with an acoustic radiation arrangement. The watch includes a watch case, which is formed at least of a case middle and a back cover removably fixed to the case middle, and at least one crystal for closing said case. A timepiece movement with a musical or striking mechanism may be disposed in a space in the watch case. The acoustic radiation arrangement is adapted to fit inside the watch case.

BACKGROUND OF THE INVENTION

In a watch, a striking mechanism may be provided to generate a sound or piece of music. To achieve this, the gong of the striking watch or the vibration plate of the musical watch are generally arranged inside the watch case. Thus, the vibrations of the gong or the vibration plate strips are transmitted to the various external parts of the watch. These external parts are, for example, the case middle, the bezel, the crystal and the back cover of the watch case. These large external parts start to radiate sound into the air under the effect of the transmitted vibrations. When a sound is produced either by a gong struck by a hammer, or by the vibration of one or more strips of the vibration plate, these external parts are capable of radiating the produced sound into the air.

One or more membranes arranged inside the watch case may be used as additional external components or elements. These membranes are configured to improve the acoustic level of the sound or music produced. Other external watch parts may also be adapted to produce good sound radiation, notably at low frequencies. However, it is difficult to envisage optimising the acoustic radiation of the back cover of the watch case, which is an external part that usually remains virtually inactive acoustically.

It is to be noted that, when the watch is worn on a user's wrist, the vibration of the lower back surface of the watch case is damped on contact with the wrist. In such case, the only solution for creating a sound or piece of music leaving the back side of the watch case consists in using lateral openings. Radiation through the lateral openings in the back cover remains low however, since several parts surrounding said openings are rigid. Further, if the back cover is provided with a crystal allowing the movement to be viewed from below, dirt can enter through the openings in the back cover and thus be deposited on the lower surface of the back crystal. Such a back cover provided with a crystal also suffers from inadequate sealing. These are drawbacks.

In a musical or striking watch, acoustic efficiency, based on the complex vibroacoustic transduction of the external parts, is generally low. In order to improve and increase the acoustic level perceived by the user of the striking or musical watch, the material, geometry and boundary conditions of the external parts must be taken into account. The configurations of these external parts are also dependent upon the aesthetic appearance of the watch and operating stresses, which may limit adaptation possibilities.

The frequency content of the sound from a striking or musical watch must be rich in a frequency range between 1 kHz and 6 kHz. Conventional external parts do not allow efficient radiation in this frequency range. As described above, in order to further improve the vibroacoustic efficiency of the striking mechanism, one or more membranes may be placed inside the watch case. The membranes can easily be sized and configured for efficient radiation of the note or notes produced in the watch case. The frequencies of the notes produced must be close to the natural vibration modes of the membranes in order for them to resonate.

Constraints relating to the arrangement of acoustic membranes are generally at variance with the rules of mechanical design for ensuring impermeable sealing, and the mechanical resistance of the watch to shocks and high external pressures. The back cover of the striking or musical watch, which is normally pierced with openings, also requires the connection between the membrane or membranes and the rest of the movement to remain sealed. Further, a membrane having a too low level of stiffness cannot ensure sufficient resistance to external pressure without risking damage to the movement, which is a drawback.

SUMMARY OF THE INVENTION

It is therefore an object of the invention to overcome the aforementioned prior art drawbacks by providing a musical watch or a striking watch, which is provided with an acoustic radiation arrangement that can improve acoustic efficiency over a broad frequency range and also ensure the impermeable sealing and resistance to high external pressure of the watch case.

To this end, the invention concerns a musical or striking watch, which is provided with an acoustic radiation arrangement, the watch including a watch case formed at least of a case middle and a back cover removably secured to the case middle and at least a front crystal for closing said case, wherein the acoustic radiation arrangement includes a connecting support part fixed in the back cover of the case between a back bezel and a back crystal, wherein the back bezel includes several lateral openings, and wherein a cavity is defined between the connecting support part and the lateral openings of the back crystal.

To this end, the invention concerns a musical or striking watch, which is provided with an acoustic radiation arrangement, the watch including a watch case formed at least of a case middle and a back cover removably secured to the case middle and at least one crystal for closing said case, wherein the acoustic radiation arrangement includes a connecting support part fixed in case between the case middle or a bezel and the crystal, wherein the case middle or the bezel includes several lateral openings, and wherein a cavity is defined between the connecting support part and the lateral openings in the case middle or the bezel.

Particular embodiments of the musical or striking watch, which is provided with an acoustic radiation arrangement, are defined in the dependent claims 2 to 13 and 15 to 26.

One advantage of the musical or striking watch lies in the fact that with the acoustic radiation arrangement, it is possible to incorporate a cavity in the watch case, even a case with a back crystal, without the risk of dirt. An efficient vibroacoustic coupling is thus obtained between the cavity and an element that vibrates, notably radially, inside the watch case and preferably inside the back cover.

Owing to the acoustic radiation arrangement, there is observed an optimisation of the sound produced, in particular by the back crystal, when the watch is not worn on the wrist.

Further, there is observed an optimisation of the sound transmitted by the cavity of the back cover through the lateral openings, even when the watch is worn on the wrist.

An increase in the duration of the sound is also observed with the acoustic radiation arrangement. The acoustic quality factor is increased by the coupling between the connecting and support part and the back crystal with mechanical degrees of freedom. Further, part of the noise generated by the mechanism is reduced as a result of the anti-resonance phenomenon created by the vibroacoustic coupling between the cavity and the connecting support part.

The connecting support part of the arrangement ensures sealing, even where said part is concealed by the external watch parts or back bezel. The watch with the acoustic radiation arrangement can withstand high pressure, for example on the order of 3 bars.

With a back crystal, it is possible for the mechanical movement to be made visible even in the presence of a resonant cavity. No dirt, which can enter the openings in the cavity, can be deposited on the inner surface of the back crystal. The connecting support part therefore not only protects the crystal from dirt but ensures good sealing of the components arranged inside the watch case.

BRIEF DESCRIPTION OF THE DRAWINGS

The objects, advantages and features of the musical or striking watch provided with the acoustic radiation arrangement will appear more clearly in the following description on the basis of at least one non-limiting embodiment illustrated by the drawings, in which.

DETAILED DESCRIPTION OF THE INVENTION

In the following description, reference is mainly made to the acoustic radiation arrangement of a musical or striking watch, which is arranged of the back side of the watch. However, it is to be noted that such an acoustic radiation arrangement may also be arranged on the front side of the watch, i.e. on the side where the time display is viewed, as explained below.

Figure 1:
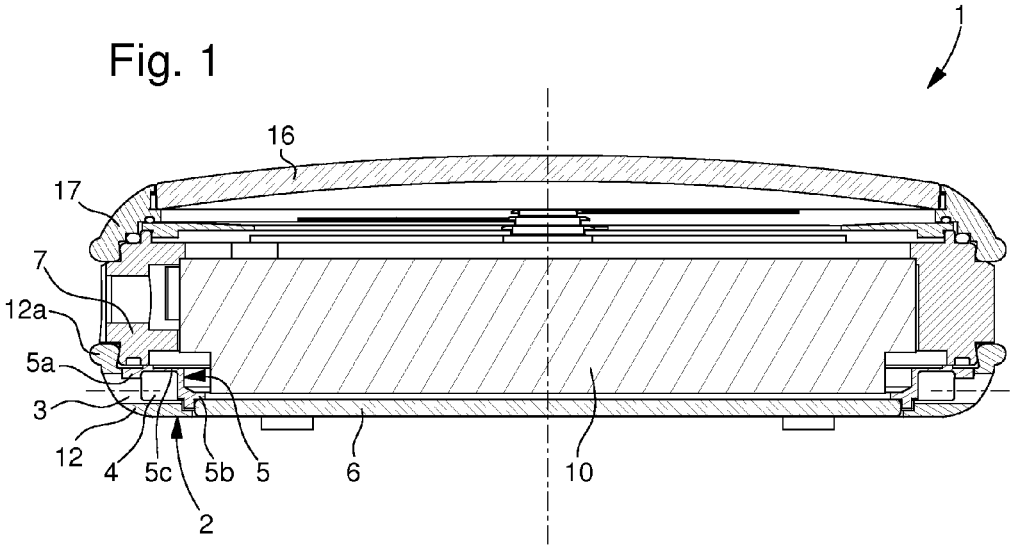
FIG. 1 shows a simplified cross-section of a striking or musical watch, which is provided with an acoustic radiation arrangement according to the invention.

FIG. 1 shows a cross-section of a striking or musical watch 1. This watch includes a watch case, which is mainly formed of a case middle 7 and a back cover 2, and at least a front crystal 16 above a watch dial for closing the watch case. Preferably, the front crystal 16 is fixed to a bezel 17, which is sealably connected to the upper opening of case middle 7. A timepiece movement 10 with a musical or striking mechanism is placed in a suitable space in the watch case. The watch also includes an acoustic radiation arrangement, which may be made in watch case back 2, as explained below.

Figure 3:
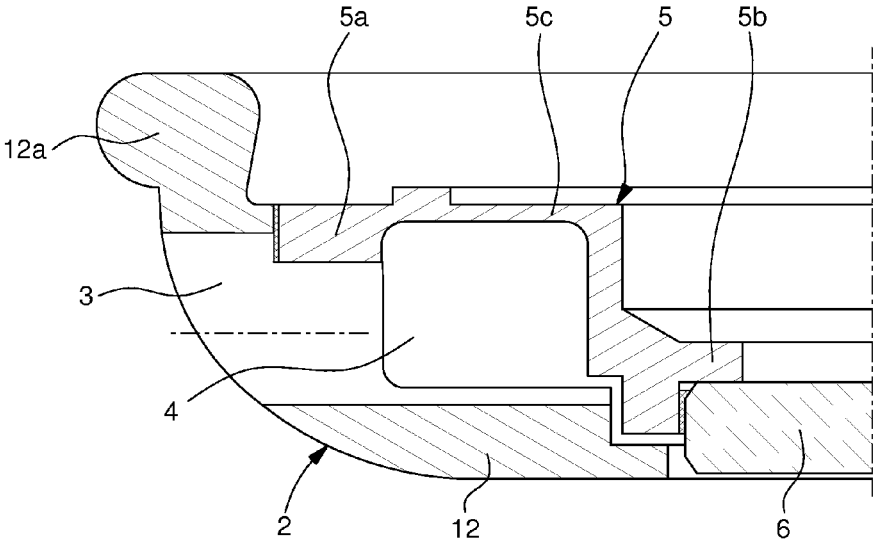
FIG. 3 shows a detailed cross-section of the acoustic radiation arrangement of the watch according to the invention.
Figure 2:
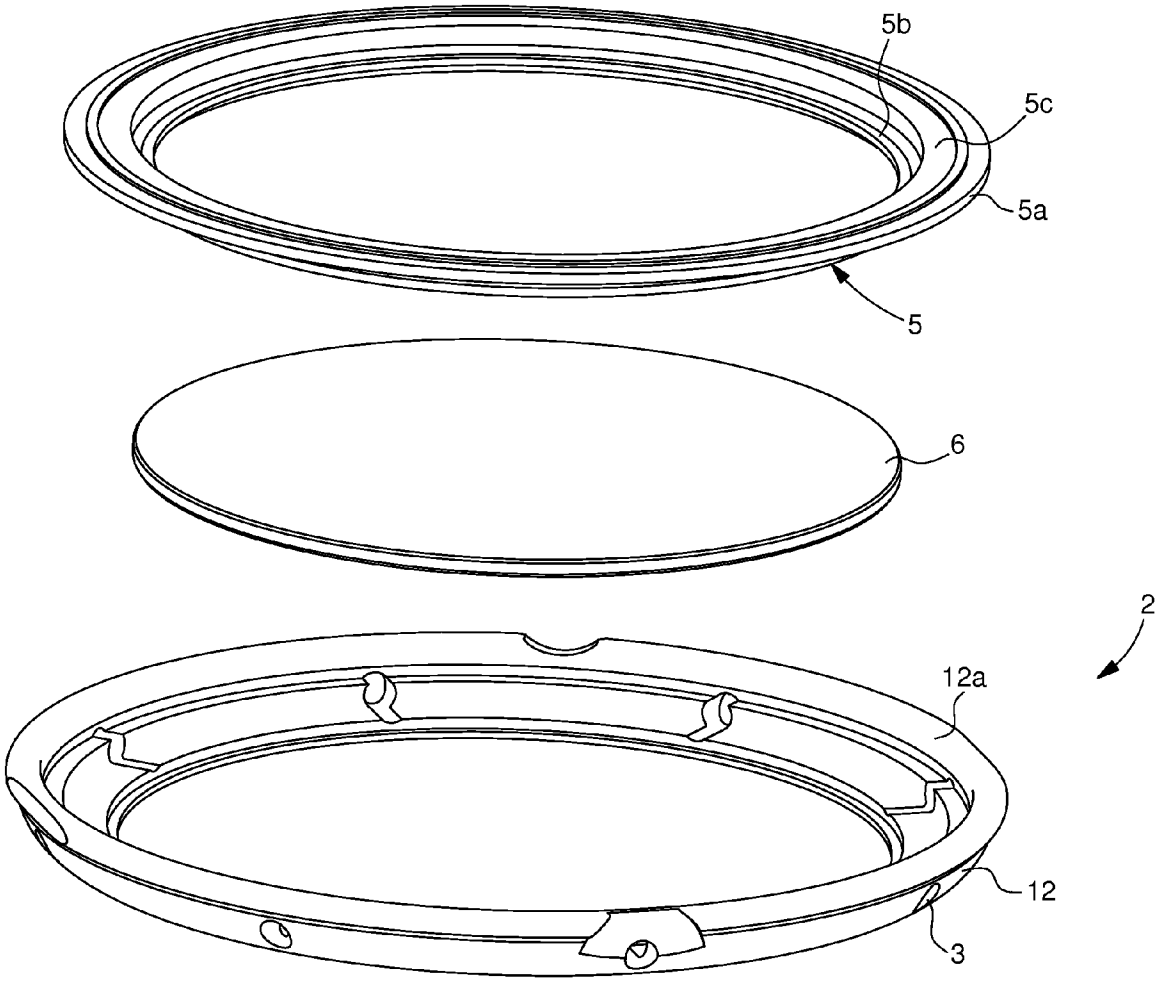
FIG. 2 shows an exploded three-dimensional view of the elements of the acoustic radiation arrangement in a back cover of the watch case according to the invention.

As is more specifically shown in FIGS. 2 and 3, this acoustic radiation arrangement includes a connecting support part 5, which is fixed in case back 2. This connecting support part 5 is arranged between a back bezel 12 and a back crystal 6. The connecting support part is formed of two rigid portions 5*a*, 5*b*, which are respectively held in contact with an inner wall of back bezel 12 and with a lateral or edge surface of back crystal 6.

These first and second rigid portions 5*a*, 5*b* may preferably be adhesive bonded, on the one hand, to an inner wall of the back bezel 12, and on the other hand, to back crystal 6. The first rigid portion 5*a* may also be fixed to the inner wall of the back bezel 12 simply by friction or by screws. However, crystal 6 is not bonded at the back opening of back bezel 12 in order to allow crystal 6 to vibrate in a piston type vibration mode. Connecting and support part 5 is thus fixed to back bezel 12 and to crystal 6 while ensuring good sealing of the interior of the watch case.

Connecting support part 5 also includes an intermediate portion 5*c*, which is preferably flexible and of very small thickness. This intermediate portion 5*c* connects the two rigid portions 5*a* and 5*b*. Preferably, portions 5*a*, 5*b*, 5*c* form a one-piece component, made of the same material. However, portions 5*a*, 5*b*, 5*c* could also be produced separately and subsequently assembled to form connecting support part 5. This flexible intermediate portion 5*c* permits vibration of the back crystal at low frequencies, if the musical or striking watch is not being worn on a user's wrist.

The back bezel 12 also includes several lateral openings 3 for the passage of at least one sound produced by the musical or striking mechanism. These lateral openings 3 are preferably oriented in the plane of the watch. There may be provided, for example, between 2 and 8 openings, as shown in FIG. 2, which are regularly distributed or spaced over the periphery of back bezel 12. A cavity 4 is defined between connecting support part 5 and openings 3 of back bezel 12, which define tubes towards the exterior from said acoustic cavity. Since connecting support part 5 is preferably made in the form of a ring, annular cavity 4 is defined over the entire periphery of connecting support part 5 facing an inner surface of back bezel 12.

In a variant embodiment, back bezel 12 may include several lateral openings 3 disposed on a sector of the back bezel. The dimensions of this sector may be smaller than or equal to half of back bezel 12. In the case of a circular back bezel, the angular sector extends over a portion of the back bezel less than or equal to 180°. Lateral openings 3 of back bezel 12 may be oriented perpendicularly to flexible intermediate portion 5*c* if the intermediate portion is in the plane with first rigid portion 5*a*, or to back crystal 6.

It is also to be noted that the thickness of intermediate portion 5*c* depends on the material used for connecting support part 5. In the case of a connecting support part 5 made of red gold and having a first natural resonant frequency of around 7,000 Hz, the thickness of flexible intermediate portion 5*c* may be comprised between 0.1 and 0.3 mm, and preferably on the order of 0.14 mm. This connecting support part 5 may also be made of yellow or grey gold, platinum or metallic glass. The finer flexible portion 5*c* is, the lower will be the frequency of the first natural mode. The diameter of connecting support part 5 may be generally comprised between 20 and 40 mm and roughly corresponds to the inner diameter of back bezel 12.

As shown in more detail in FIG. 3, intermediate portion 5*c* is disposed in the same plane as first rigid portion 5*a*, and also parallel to back crystal 6. First rigid portion 5*a* is fixed to an inner edge and an inner wall of back bezel 12 and partly in an upper part of cylindrical openings 3. However, intermediate portion 5*c* is connected to a perpendicular part of second rigid portion 5*b*. Thus, connecting support part 5 provides vibroacoustic coupling between acoustic cavity 4 and flexible intermediate portion 5*c* as a vibrating membrane in the form of a circular crown.

It is also possible for intermediate portion 5*c* to be disposed in the same plane as second rigid portion 5*b* and substantially perpendicular to first rigid portion 5*a* of connecting support part 5 or back crystal 6. It is also possible for a first part of intermediate portion 5*c* to be disposed in the same plane as first rigid portion 5*a* and a second part to be disposed in the same plane as second rigid portion 5*b*.

Back bezel 12 also includes a securing edge portion 12*a* to secure said bezel to the lower part of case middle 7 as shown in FIG. 1. Once back bezel 12 is secured via securing edge portion 12*a* to the lower part of case middle 7, first rigid portion 5*a* of connecting support part 5 is in direct contact with case middle 7. The vibration of case middle 7 thus directly sets connecting support part 5 in vibration by means of flexible intermediate portion 5*c*. This makes it possible to maximise the vibration transfer between a vibration generator of the musical or striking mechanism and a radiating element, which may be back crystal 6 and/or acoustic cavity 4.

It is also to be noted that the axial and radial vibration of connecting support part 5 produces two effects. The first effect is to set back crystal 6 in vibration in piston type vibration modes without deforming said back crystal. The second effect is to modulate the volume of acoustic cavity 4, one of the walls of which is flexible intermediate portion 5*c*, which activates a resonant mode of said cavity 4. This resonant mode of the cavity may be acoustically active with radiation towards the exterior of the watch through openings 3, or acoustically inactive by acting as a damper according to the vibration frequency.

With the acoustic radiation arrangement inside back cover 2, the actual vibration modes and acoustic modes, which are pressure waves, do not coincide with the individual modes of connecting support part 5 and of back crystal 6. The actual vibration modes and the acoustic modes also do not coincide with the purely acoustic modes of cavity 4. The coupled modes whose main contribution is vibration act as sound damping modes, whereas the modes whose main contribution is acoustic pressure modulation act as amplified radiation modes.

Figure 4:
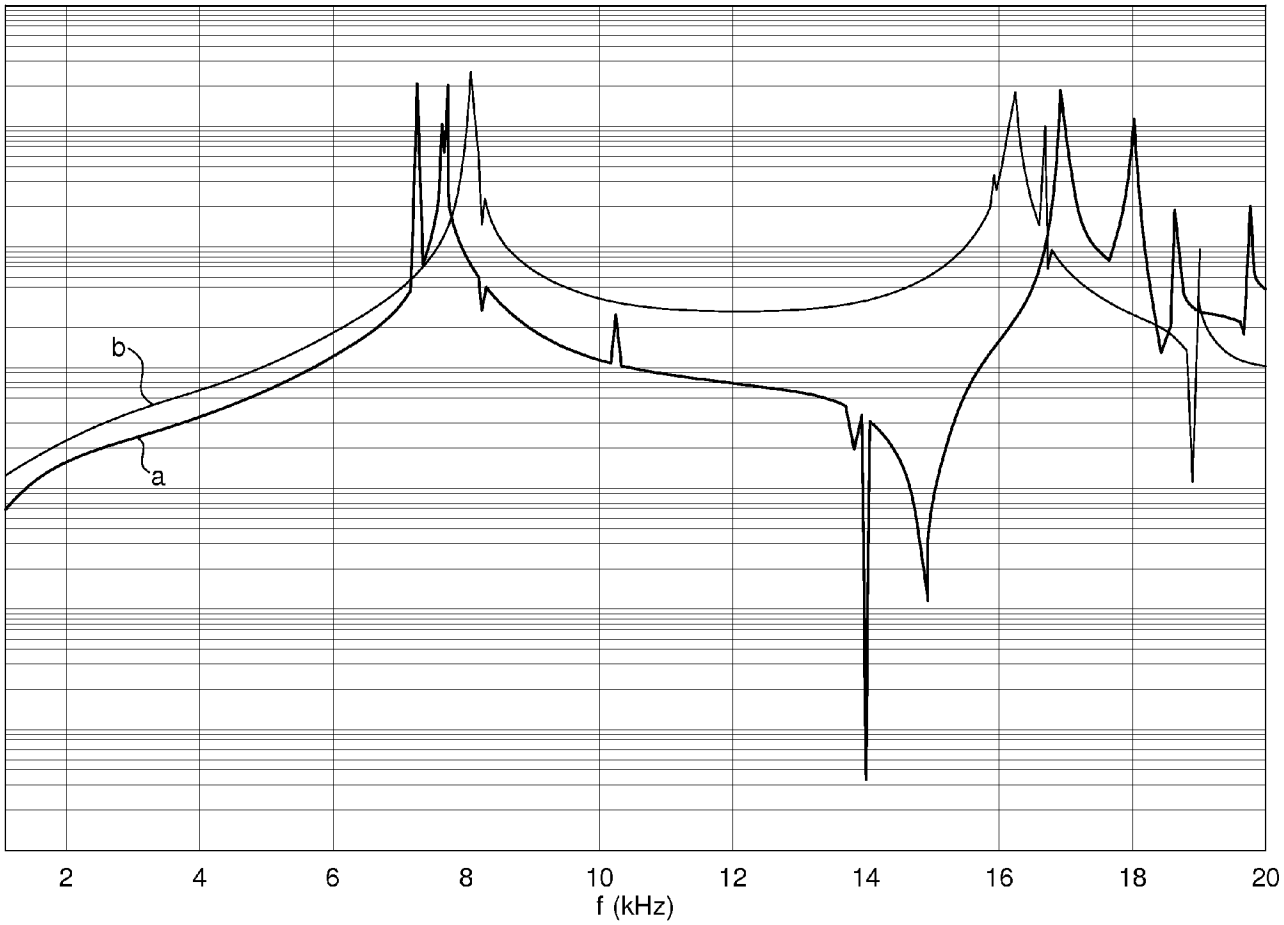
FIG. 4 shows a graph of the vibration frequency responses of a standard back cover and of a back cover with vibroacoustic coupling of the present invention.

FIG. 4 shows a comparison of the vibration frequency responses of a standard back cover and of a back cover with vibroacoustic coupling with the acoustic radiation arrangement. This acoustic radiation arrangement is optimised as described above with reference to FIGS. 1 to 3. Connecting support part 5 of the acoustic radiation arrangement may be made of red gold.

In the case of a standard back cover represented on curve b, the axial acceleration of the back crystal has only two resonances. The frequency of the first resonance is 8 kHz. However, in the case of the back cover with vibroacoustic coupling of the invention on curve a, the frequency of the first resonance is reduced by around 1 kHz to be at 7 kHz. The quality factor is increased with a reduced peak width, which corresponds to a significant increase in the duration of vibration, and therefore of the sound produced. On curve a representing the back cover with vibroacoustic coupling of the invention, there is also an anti-resonance, i.e. a local minimum, which is introduced at around 15 kHz. This makes it possible to remove the noise components from the mechanism, which are present in this frequency range.

It is to be noted that, owing to the acoustic radiation arrangement shown in FIGS. 1 to 3, dirt, which can enter through lateral openings 3 in cavity 4, cannot be deposited on the inner surface of back crystal 6. Connecting support part 5 completely protects the back crystal from any dirt from the exterior and ensures the sealing of the watch case interior.

With back crystal 6, it is possible for movement 10 to be made visible inside the watch case. This property is generally difficult to obtain for an active back cover acoustically optimised with a resonant cavity.

According to a variant embodiment, lateral openings 3 in acoustic cavity 4 can be partially closed by membranes having small holes. The small holes in these membranes allow the passage of air while protecting the interior of the cavity from accumulating dirt.

To make the acoustic radiation arrangement shown in FIGS. 1 to 3 inside watch case back 2, the materials envisaged are preferably metallic materials or metallic glasses. This could be grey, yellow or red gold for back bezel 12, grey, yellow or red gold, platinum and metallic glasses for connecting support part 5.

The acoustic radiation arrangement may also be made on the side of crystal 16 of watch 1 shown in FIG. 1. In such case, the connecting support part is connected between the upper portion of case middle 7 or bezel 17 and front crystal 16. Lateral openings may also be provided between case middle 7 or bezel 17 and the connecting support part 5. An annular cavity 4 is formed between the connecting support part and the openings in case middle 7 or bezel 17. A first rigid portion 5*a* may be fixed to an inner wall of the case middle or of the bezel, whereas a second rigid portion 5*b* may be fixed to a lateral surface or edge portion of crystal 16. Intermediate portion 5*c* may be configured and arranged with respect to rigid portions 5*a* and 5*b* as specified with reference to FIGS. 1 to 3.

It is also to be noted that the lateral openings 3 in case middle 7 or bezel 17 may also be distributed over a sector of case middle 7 or of bezel 17. The dimensions of this sector may be smaller than or equal to half the periphery of case middle 7 or of bezel 17. The lateral openings 3 in case middle 7 or in bezel 17 may be oriented perpendicularly to crystal 16.

From the description that has just been given, several variants of a musical or striking watch having an acoustic radiation arrangement can be devised by those skilled in the art without departing from the scope of the invention defined by the claims. An acoustic radiation arrangement may be provided on the back side of the watch case and on the front crystal side of the watch. The lateral openings may be of different dimensions and of different shape from the cylindrical shape. The flexible intermediate portion, which is annular, may exhibit a wave. The connecting support part may be obtained by moulding or drawing a preform. One or more acoustic membranes may also be provided between the musical or striking mechanism and the acoustic radiation arrangement.

What is claimed is:

1. A musical or striking watch, which is provided with an acoustic radiation arrangement, the watch including a watch case formed at least of a case middle and a back cover removably secured to the case middle and at least a front crystal for closing said case, wherein the acoustic radiation arrangement includes a connecting support part fixed in the back cover of the case between a back bezel and a back crystal, wherein the back bezel includes several lateral openings, and wherein a cavity is defined between the connecting support part and the lateral openings of the back bezel.

2. The musical or striking watch according to claim 1, wherein the connecting support part is of annular shape and includes two rigid portions and a flexible intermediate portion between the two rigid portions.

3. The musical or striking watch according to claim 2, wherein the connecting support part, which includes the two rigid portions and the flexible intermediate portion, is made in one piece.

4. The musical or striking watch according to claim 2, wherein the material of the connecting support part is selected among gold, platinum or a metallic glass, and wherein the thickness of the flexible intermediate portion is comprised between 0.1 mm and 0.3 mm, preferably on the order of 0.14 mm.

5. The musical or striking watch according to claim 2, wherein a first rigid portion is fixed to an inner wall of the back bezel, and wherein a second rigid portion is fixed to a lateral or edge surface of the back crystal, the connecting support part ensuring the sealing of the watch case interior.

6. The musical or striking watch according to claim 5, wherein the flexible intermediate portion is arranged in the same plane as the first rigid portion and substantially perpendicular to the second rigid portion of the connecting support part.

7. The musical or striking watch according to claim 5, wherein the flexible intermediate portion is arranged in the same plane as the second rigid portion and substantially perpendicular to the first rigid portion of the connecting support part.

8. The musical or striking watch according to claim 5, wherein the flexible intermediate portion includes a first part arranged in the same plane as the first rigid portion and a second part arranged in the same plane as the second rigid portion.

9. The musical or striking watch according to claim 1, wherein the cavity, which is defined between the connecting support part and the lateral openings in the back bezel, is annular.

10. The musical or striking watch according to claim 1, wherein the lateral openings are oriented in the plane of the watch.

11. The musical or striking watch according to claim 6, wherein the lateral openings in the back bezel are oriented perpendicularly to the flexible intermediate portion.

12. The musical or striking watch according to claim 1, wherein the number of lateral openings is comprised between 2 and 8, and wherein the lateral openings are regularly spaced from each other.

13. The musical or striking watch according to claim 1, wherein the lateral openings are distributed over a sector of the back bezel that is less than or equal to half the back bezel.

14. A musical or striking watch, which is provided with an acoustic radiation arrangement, the watch including a watch case formed at least of a case middle and a back cover removably secured to the case middle and at least one crystal for closing said case, wherein the acoustic radiation arrangement includes a connecting support part fixed in case between the case middle or a bezel and the crystal, wherein the case middle or the bezel includes several lateral openings, and wherein a cavity is defined between the connecting support part and the lateral openings in the case middle or the bezel.

15. The musical or striking watch according to claim 14, wherein the connecting support part is of annular shape and includes two rigid portions and a flexible intermediate portion between the two rigid portions.

16. The musical or striking watch according to claim 15, wherein the connecting support part (5), which includes the two rigid portions (5*a*, 5*b*) and the flexible intermediate portion (5*c*), is made in one piece.

17. The musical or striking watch according to claim 15, wherein the material of the connecting support part is selected among gold, platinum or a metallic glass, and wherein the thickness of the flexible intermediate portion is comprised between 0.1 mm and 0.3 mm, preferably on the order of 0.14 mm.

18. The musical or striking watch according to claim 15, wherein a first rigid portion is fixed to an inner wall of the case middle or of the bezel, and wherein a second rigid portion is fixed to a lateral or edge surface of the crystal, the connecting support part ensuring the sealing of the interior of the watch case.

19. The musical or striking watch according to claim 18, wherein the flexible intermediate portion is arranged in the same plane as the first rigid portion and substantially perpendicular to the second rigid portion of the connecting support part.

20. The musical or striking watch according to claim 18, wherein the flexible intermediate portion is arranged in the same plane as the second rigid portion and substantially perpendicular to the first rigid portion of the connecting support part.

21. The musical or striking watch according to claim 18, wherein the flexible intermediate portion includes a first part arranged in the same plane as the first rigid portion and a second part arranged in the same plane as the second rigid portion.

22. The musical or striking watch according to claim 14, wherein the cavity, which is defined between the connecting support part and the lateral openings in the case middle or the bezel, is annular.

23. The musical or striking watch according to claim 14, wherein the lateral openings are oriented in the plane of the watch.

24. The musical or striking watch according to claim 19, wherein the lateral openings in the middle part or in the bezel are oriented perpendicularly to the flexible intermediate portion.

25. The musical or striking watch according to claim 14, wherein the number of lateral openings is comprised between 2 and 8, and wherein the lateral openings are regularly spaced from each other.

26. The musical or striking watch according to claim 14, wherein the lateral openings are distributed over a sector of the case middle or of the bezel that is less than or equal to half the periphery of the case middle or of the bezel.

* * * * *